US005261335A

United States Patent [19]

Blevins, Jr.

[11] Patent Number: 5,261,335

[45] Date of Patent: Nov. 16, 1993

[54] FIREBOX FURNACE WITH AUTOMATIC FEEDING SYSTEM

[76] Inventor: Leslie Blevins, Jr., R.R. #1, Lawrence, Kans. 66044

[21] Appl. No.: 997,916

[22] Filed: Dec. 29, 1992

[51] Int. Cl.[5] ..... F23K 3/00

[52] U.S. Cl. ..... 110/101 C; 110/101 CF; 110/108; 110/116; 110/186; 110/204; 110/212; 110/225; 110/235; 126/58

[58] Field of Search ..... 110/108, 101 C, 101 CF, 110/118, 225, 102, 116, 101 R, 235, 101 CA, 186, 204, 212; 126/58

[56] References Cited

U.S. PATENT DOCUMENTS

| | | | |
|---|---|---|---|
| 4,331,084 | 5/1982 | Fitch et al. | 110/186 |
| 4,539,915 | 9/1985 | Bouron | 110/101 C X |
| 5,020,453 | 6/1991 | Katsui | 110/225 X |
| 5,022,328 | 6/1991 | Robertson | 110/186 X |
| 5,195,449 | 3/1993 | Michimae | 110/225 X |

*Primary Examiner*—Edward G. Favors
*Attorney, Agent, or Firm*—Barnes & Thornburg

[57] ABSTRACT

An automatic firebox provided with a fuel hopper that delivers fuel through a pivoting funnel to a grate burning area. The grate burning area is provided with at least one pivoting fuel grate which operates automatically in sequence with the fuel feed and hopper so as to provide automatic stoking. An automatic control operated by temperature and/or time is disclosed.

43 Claims, 6 Drawing Sheets

FIREBOX FURNACE WITH AUTOMATIC FEEDING SYSTEM

BACKGROUND AND SUMMARY OF THE INVENTION

This invention relates to a firebox provided with an automatic fuel feeding system and is an improvement over my previous firebox design as shown in U.S. Pat. No. DES 270,370 of Aug. 30, 1983.

Fireboxes used for heating purposes have enjoyed a new resurgence with the onset of the ecology movement and the desire to avoid the burning of fossil fuels. Additionally, these fireboxes have utility as smelters to liquify metals used in foundry work by blacksmiths, farmers and hobbyists as well as for reclamation and recycling purposes.

Because of their size and the amount of heat to be generated, operation of fireboxes for heating homes, cabins, rooms, etc. has been limited. This is due to the fact that these fireboxes have to be frequently refueled and de-ashed. Consequently, their use as heaters for human comfort has not been a big success.

It is an object of the instant invention to provide a firebox that can provide heating for a long period of time without the previously mandated hand refueling, stoking and repeated ash removal.

It is a further object of this invention to provide a firebox capable of burning many different types of fuel, such as wood chips, pressed paper, briquettes, pelletized combustible material, etc.

Additionally, the firebox of this invention is capable of assisting with a solution to the pollution problem by being able to burn aerosol cans, oil filters, tires and other contaminants. After burning the burned containers or steel tire wires can be recycled in a smelting operation. The fact that the container has been scorched, does not act as a detriment in the recycling process.

Objects of the invention are carried out by providing an automatic fuel feed hopper for storage of fuel and subsequent feeding thereof to the firebox.

An automatic stoking mechanism is also disclosed for movement of the fuel through the firebox as the combustion process progresses. As a preferred embodiment, the firebox is provided with a plurality of grates, one located vertically above the other. Pivot means are also provided to cyclically operate the grates to allow for the burning fuel located thereon to be progressively passed downward through the firebox from an upper to a lower grate during the burning process.

A simplified ash removal system is disclosed to provide for automatic ash removal.

Also provided is an automatic control system for regulating the amount of heat generated and to coordinate the automatic fuel feeding hopper system with the automatic grates for automatic and controlled stoking of the firebox.

An exhaust recycling system is provided to insure complete combustion and an exhaust gas purification system is also provided.

Other objects, advantages and novel features of the present invention will become apparent from the following detailed description of the invention when considered in conjunction with the accompanying drawings.

DETAILED DESCRIPTION OF THE DRAWINGS

Figure 2:
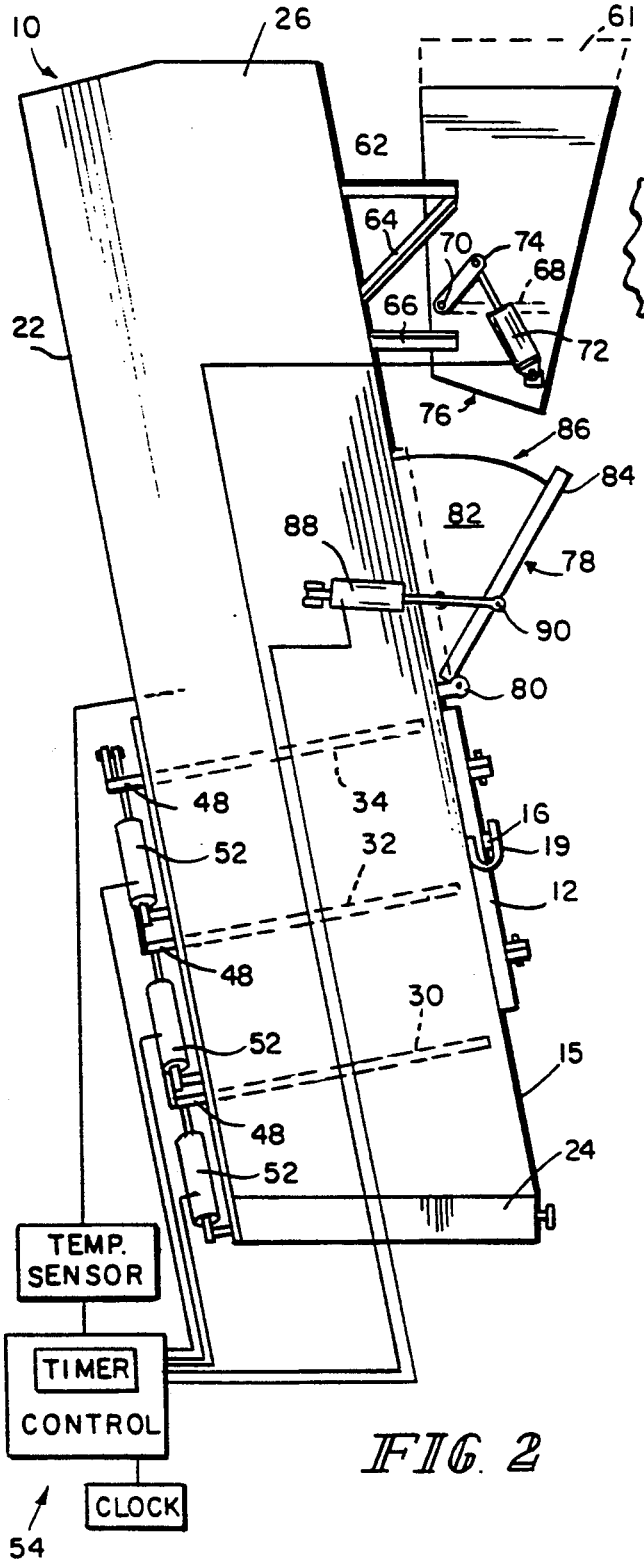
FIG. 2 is a LEFT side view of the firebox shown in FIG. 1 also depicting the power cylinders for an automatic stoker system, and with the automatic control shown schematically.
Figure 1:
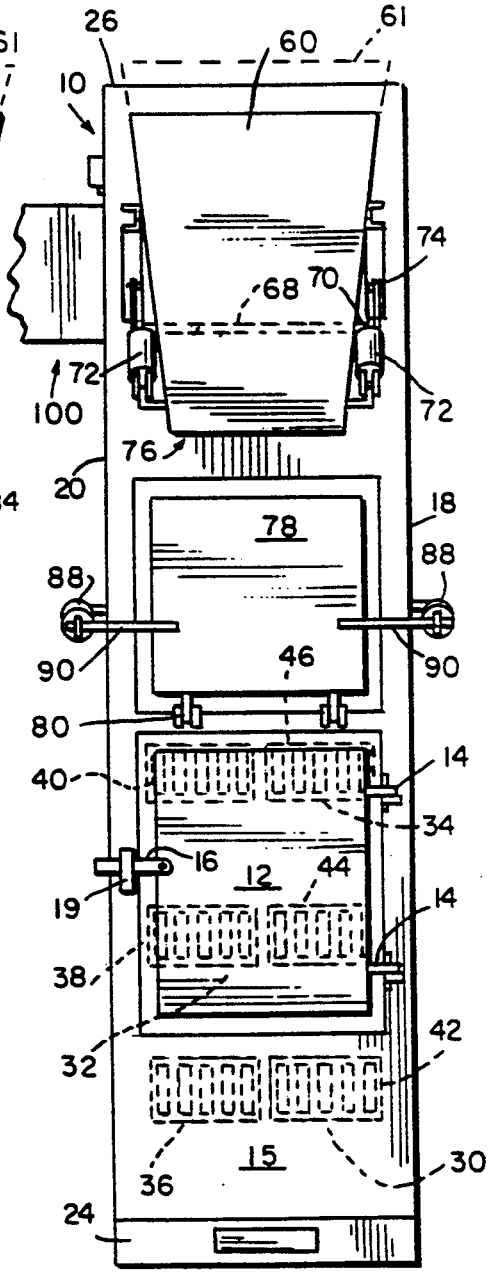
FIG. 1 is a front view of the firebox showing the vertical arrangement of an automatic hopper, an automatic fuel feeder, a funnel door, a manual door, and ash receptor with their power cylinders. Also, the fuel grates are shown in dotted lines.

FIG. 1 shows a firebox 10 having a front manually operated door 12. The door is mounted to the firebox on generally vertical axial hinges 14 and is held biased to a closed position due to the angling of the front panel 15 of the firebox. A pivoting latch lever 16 cooperates with a u-shaped retainer bar 19 to lock the manual door 12 in its closed position. The firebox 10 is generally rectangular in shape with side walls 18, 20 and rear wall 22. The firebox is tilted rearwardly as clearly seen in FIG. 2.

The firebox 10 is provided with a handled ash tray 24 at its bottom. For automatic emptying of the ash try, an auger conveyor (not shown) can be extended through a wall of the firebox 10 to extend into the ash tray to be utilized to withdraw the ashes as the auger rotates and lifts these ashes to a storage receptacle nearby. Alternatively, for light ash loads, a manual unloading of the tray is possible. This tray rests on runners (not shown) and slides outwardly towards the front of the firebox 10 in a drawer-like manner to allow for easy ash removal. The tray 24 can have rear or side handles (not shown) to allow for ease in lifting and dumping the ashes from the firebox 10. The size of the ash tray 24 is shown schematically and depends on the type of fuel normally intended to be burned and the amount of ash therefrom. The height and volume of the ash tray 24 can thus be varied to suit the type of fuel normally burned. Ideally the ash tray 24 will be sized for the highest ash producing fuels available.

As is conventional with fireboxes, an exhaust stack and air inlet vents (neither of which is shown to simplify the disclosure) are provided. The exhaust stack would be attached to the top 26 of the firebox 10. The air-inlets are normal damper openings which are located at the bottom of the firebox 10 at its back 22, front 16, and/or sides 18, 20.

Figure 3:
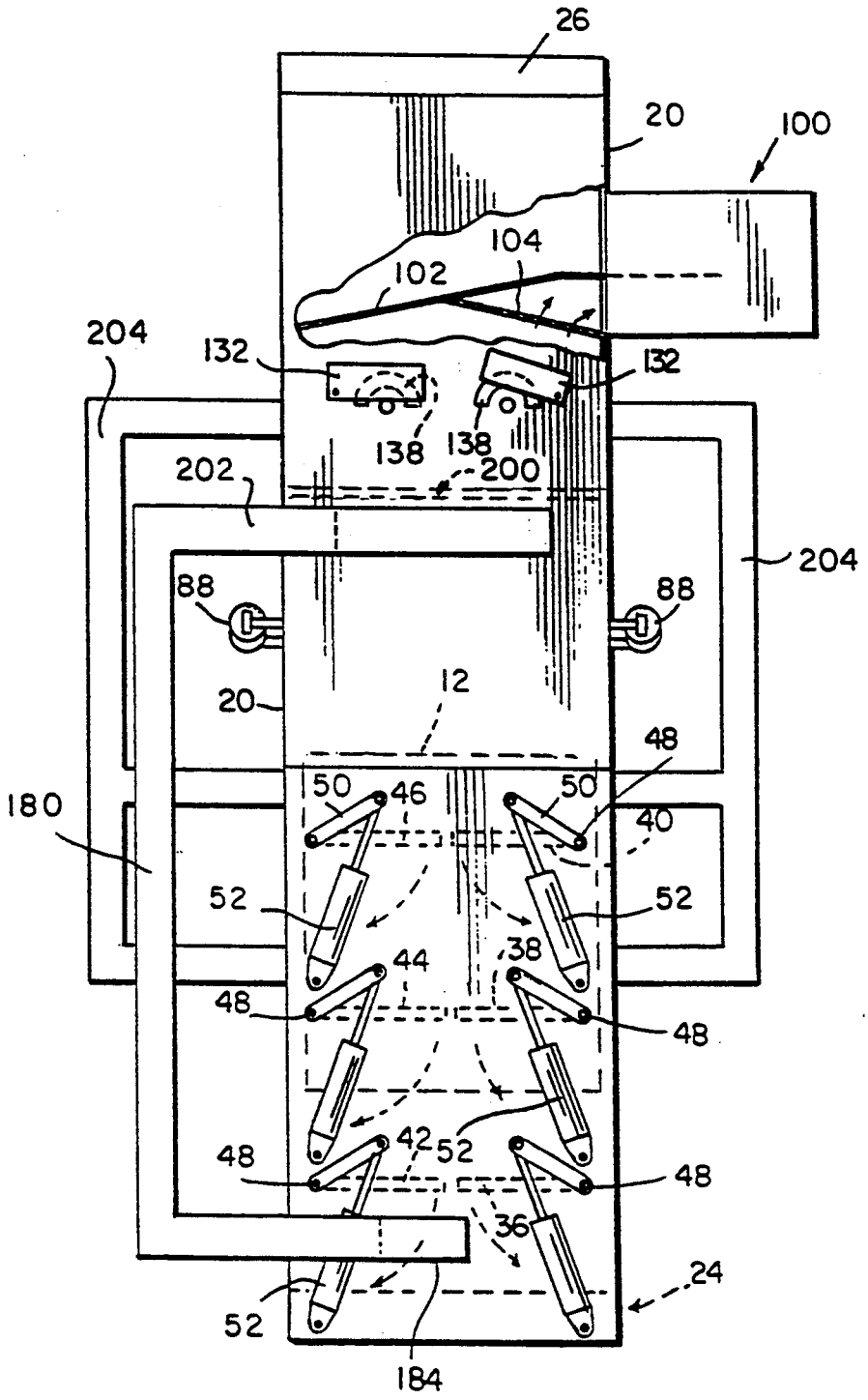
FIG. 3 is a rear view of the firebox (partially in section) of FIGS. 1 and 2 and shows an exhaust recycling schematic for the firebox.

Internally of the firebox there are a series of fuel grates as, for example, three vertical stacked rearwardly sloping fuel grates 30, 32, 34 (shown in dotted lines). Each of these grates 30, 32, 34, are split in their middle (width-wise as they extend across the firebox) into left 36, 38, 40, and right 42, 44, 46 grate sections (as shown in FIG. 1 and right to left as shown in FIG. 3). Each grate section 36, 38, 40, 42, 44, 46 is fixed to a pivot rod 48 having a crank 50 connected to a piston motor 52. Actuation of a respective piston motor (which can be an oil, compressed air or electric operated type motor) causes rotation of its respective crank 50 to rotate each grate section 36, 38, 40, 42, 44, 46 from the shown horizontal position to a vertical position about rod 48 to provide automatic fuel handling "stoking" as the grate sections 36, 38, 40, 42, 44, 46 dumps the fuel thereon to a lower grate 30, 32 or rotate to the ash collector 24 in the case of the lower grate 32. The operation of the synchronized control 54 for automatic stoking will be explained later on. While three grates 30, 32, 34 are shown, a more or less number of grates can be utilized.

A hopper 60, opened at its top (with or without extension 61) is mounted on the front side 15 of the firebox 10 at its upper end by a support frame members 62, 64, 66. Within the hopper 60 is a fuel feed gate 68 (shown in dotted lines FIGS. 1 and 2) fixedly attached to shaft 70. Motors 72 operate to rotate shaft 70 through cranks 74 to tilt the fuel feed gate 68 clockwise (FIG. 2) to allow metering of fuel, located atop the fuel grate 68, to pass out exit trough portion 76 of the hopper 60.

A fuel trough entry funnel 78 is located below the hopper 60 and is horizontally pivoted by hinge 80 to the front side 15 of the firebox 10. The fuel trough entry funnel 78 has two sides 82 and a front wall 84 with an open top area 86 that underlies the exit portion 76 of the hopper 60. The fuel trough entry funnel 78 is pivoted to an open and closed position by motors 88 connected thereto by rods 90.

In operation, the hopper 60 is loaded with fuel through its open top (or top extension 61). This entry can be by a batch loader conveyor 140 (see FIG. 8) which supplies fuel in measured amounts. This can be accomplished by running the conveyor for a set period of time, or by controlling the conveyor by the weight of fuel on the conveyor or on the fuel grate 60. The fuel rests on fuel grate 68. When it is desired to feed fuel to the firebox 10, fuel entry funnel 78 is open by motors 88 to have its open top end 86 underlie exit trough portion 76 of hopper 60. Motors 72 then pivot fuel grate 68 to allow a metered passage of some or all of the fuel atop the grate to pass by the fuel grate 68 and exit through the exit portion 76 of the hopper 60 into the funnel 78 from whence the fuel is directed onto the top pivoting gate 36 of the firebox where combustion takes place. Prior to the feeding of fuel from the trough, the motors 52 are actuated (starting with the bottom motors) to first pivot and empty the lower grate 30 onto the ash drawer 24. Next, the intermediate motor 48 is activated to pivot middle grate 32 and empty the middle grate 32 onto the lower grate 30. Lastly, the upper grate 34 is pivoted by the upper motors 48 to empty upper grate 34 onto middle grate 32. In this way, automatic stoking in three stages of burning on the grates 30, 32 and 34 takes place. While three equally spaced (in height) grates 30, 32, 34 have been found to be a most satisfactory number of grates to use, more or less grates can be used and their relative positions with respect to each other and the walls of the firebox can be changed.

Initial ignition of the firebox 10 can be obtained by opening lower door 12 and starting combustion on middle grate 32 or lower grate 30 or by automatic means.

The motors 52, 88 and 72 are controlled to operate in the above reference sequence by control 54 which includes a timer for sequence control. Also provided is a temperature sensor input which can be used to initiate the motor sequencing if the temperature of the area to be heated falls below a set level. Alternatively, or additionally, a clock is provided wherein a user can program set times for the control 54 to begin its sequence. For example, the clock could be set to feed fuel every hour from say 11:00 p.m. to 6:00 a.m. In this manner the firebox would automatically operate throughout the night unattended by a human operator.

When the firebox is used to burn contaminate containing material such as aerosol cans and oil filters, the automatic control has to be set such that the cycle of fuel feeding and automatic stoking is commensurate with the need to insure complete burning of the petroleum based material in the container. No modification of the firebox is necessary since the hopper 60 and grates 30, 32, 34 can already accommodate the contaminate containers.

Figure 6:
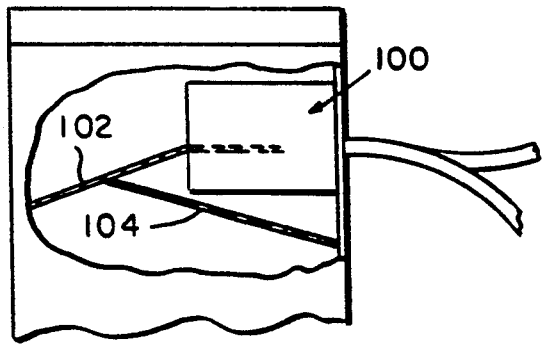
FIG. 6 is a modification of the firebox with the heat exchangers vented externally thereon.

FIG. 3 shows a firebox wherein an external heat exchanger 100 is provided. In some installations, the firebox 10 can be located outside of the room to be heated and for that a heat exchanger will extend from the firebox 10 into the room to be heated. The heat exchanger is shown on the side of the firebox in FIG. 3, but it could be located within the firebox (FIG. 6) or on the outside or on the back side. Internally of the firebox is a solid flow-check plate 102 to channel the exhaust gases to the heat exchanger 100 which can be of any conventional type, e.g., a fluid radiator, baffle plate design, etc. Across the inside of the firebox 10 is a perforated plate 104 to allow the passage of the heated air into the heat exchanger. While FIG. 3 shows the heat exchanger 100 located externally of the fire box, the heat exchanger 100 could feed pipes leading to a standard type radiator (not shown) as pictured in FIG. 6.

Figure 4:
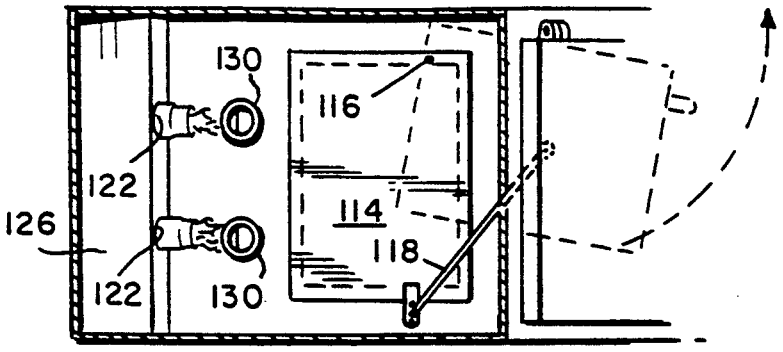
FIG. 4 is a plan view in section of an exhaust gas purifier for a modified firebox with heat exchanger and exhaust gas purifier installed, taken along the line 4—4 of FIG. 4.
Figure 5:
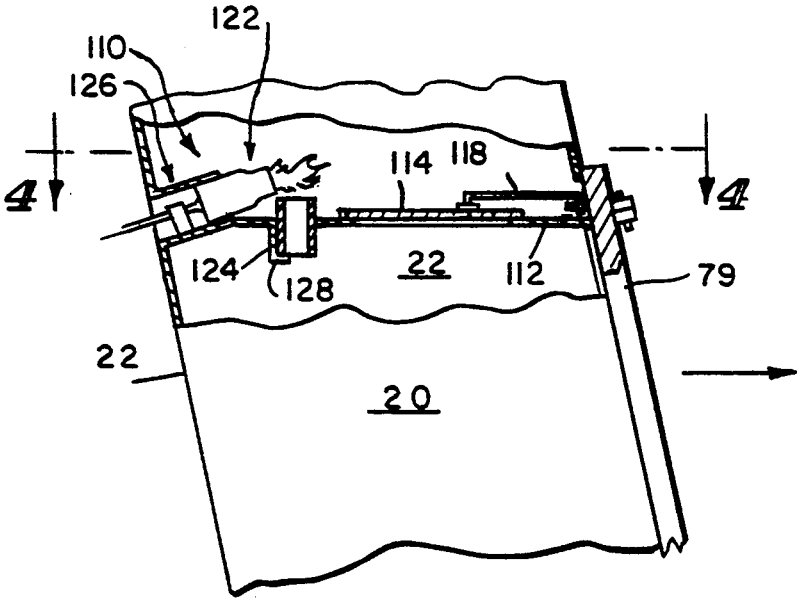
FIG. 5 is a left side view partially in section of the exhaust gas purifier.

With some fuels it will be desirable to provide a pollution or purification control 110. FIGS. 4 and 5 show such a control used on a two door firebox such as shown in my co-pending design application Ser. No. 07/724,964 filed Jul. 2, 1991. Here the top door 79 pivots about on vertical axis similarly as door 12. It should be noted that the pollution or purification system is also intended to be used in the non-heat exchanger systems and the horizontally pivoting door system of FIGS. 1 and 2. The actuating linkage 118 (explained below) would be changed to accommodate the horizontal pivoting door. Suffice it to say that the pollution control device will be located above the uppermost door and below the heat exchanger of FIG. 6.

The pollution control 110 is provided with a door frame plate 112 that has a pivoting door gate 114 pivoted at 116 thereto. In FIG. 4, the door is shown closed in solid lines and open in dotted lines. An actuator and linkage 118 is attached to the door gate 114 and to the manually operated door 12. The actuator and linkage 118 pivots the door gate 114 to open a by-pass around the purifier (to be explained later) whenever the manual door 79 is open. This will keep exhaust from pouring out of the opened manual door 79.

The purification is obtained by reburning of the exhaust gas with a gas fuel from a plurality of gas burners 122. The burners 122 are located in a compartment 126 of the firebox 10, and when ignited, shoot a flame out openings 128. The gas burners are connected to a source of gas fuel (not shown) in any conventional manner. Two or more of a plurality of air passageways 130 are located in the door frame plate 112 and are defined by small cylindrical hollow tubes set in the frame plate 112 to form chimney pipes 124, which can be ceramic or metal and which rest on support strips 128. In this manner the chimney pipe 126 can be replaced by lifting them up, tilting them and dropping them down to the grate 34. As these chimney pipes 124 get quite hot, they can deteriorate and thus replacement is sometimes necessary. The exhaust gas from the burning on the grates below and passes upwardly through these chimney pipes 124 and are further burned by the gas issuing from the gas burners 122. While only two air passageways 130 are shown, more can be utilized. For burning of automobile tires an installation of four passageways 130 was found to operate best.

To control the length of the flame from the gas burners, crescent-shaped air openings 138 (FIG. 3) are located on the side wall adjacent the gas burners 122. The openings 138 have closures 132 which can be pivoted to control the size of the openings. It is has been found that a natural draft will direct the exhaust gas though chimneys where impurities are then burned by the gas burners 122. However, in some installations a draft fan (not shown) may be attached at the inlet used to push the exhaust through the chimneys 126. Additionally having a blower (not shown) to force air through the openings enhances the draft and burning. Again, more than two openings can be utilized to obtain additional air for the combustion process. This is especially true where tires or other contaminated fuels are used. Where more than two openings are used a single outlet manifold from a blower (supercharger) can supply air to a plurality of inlets in the side walls of the firebox. The inlets would be connected to the manifold like teeth of a fork to the fork handle.

Additionally, exhaust recycling can be provided by recirculating exhaust from above the grates 30, 32, and 34 of the firebox to a point at, within or below the grates 30, 32 and 34. To this end a manifold 202 is attached to the top portion of the firebox 10 and is connected by conduct 189 (shown schematically in FIG. 3) to a lower inlet manifold 184.

Ideally, exhaust gas recycling would take place in a two or three grate system (see FIG. 3) wherein an abatement plate 200 extends completely across the top of the firebox 10, below the heat exchanger 100, to prevent burnt exhaust gas from flowing up the firebox into the heat exchanger 100. Instead, this burnt smokey exhaust will enter horizontal duct 202 leading to the recirculation duct 180 and be directed back to the firebox below the bottom grate 42. The fire on this bottom grate will burn the products in the recycled smoke and the hotter (less smoky) gas therefrom will exit the firebox through side ducts 204 and reenter the firebox above the abatement plate 200 to be fed to the heat exchanger 100, while the cooler and more smoky exhaust will be directed upwards past the grate 44 (and grate 46 in a three grate system) to be recycled again through duct 202. This type of recycling will normally not use the exhaust purification system of FIGS. 4 and 5.

While the burning grates 30, 32 and 34 have been shown as split into two portions, they could of course be unitary and only rotate from one end. Alternatively they could also be made to pivot from the back and front if they were to be split front to back rather than side to side as shown. Splitting of the grates provides for more control and even distribution on the grate below as they are operated.

Figure 7:
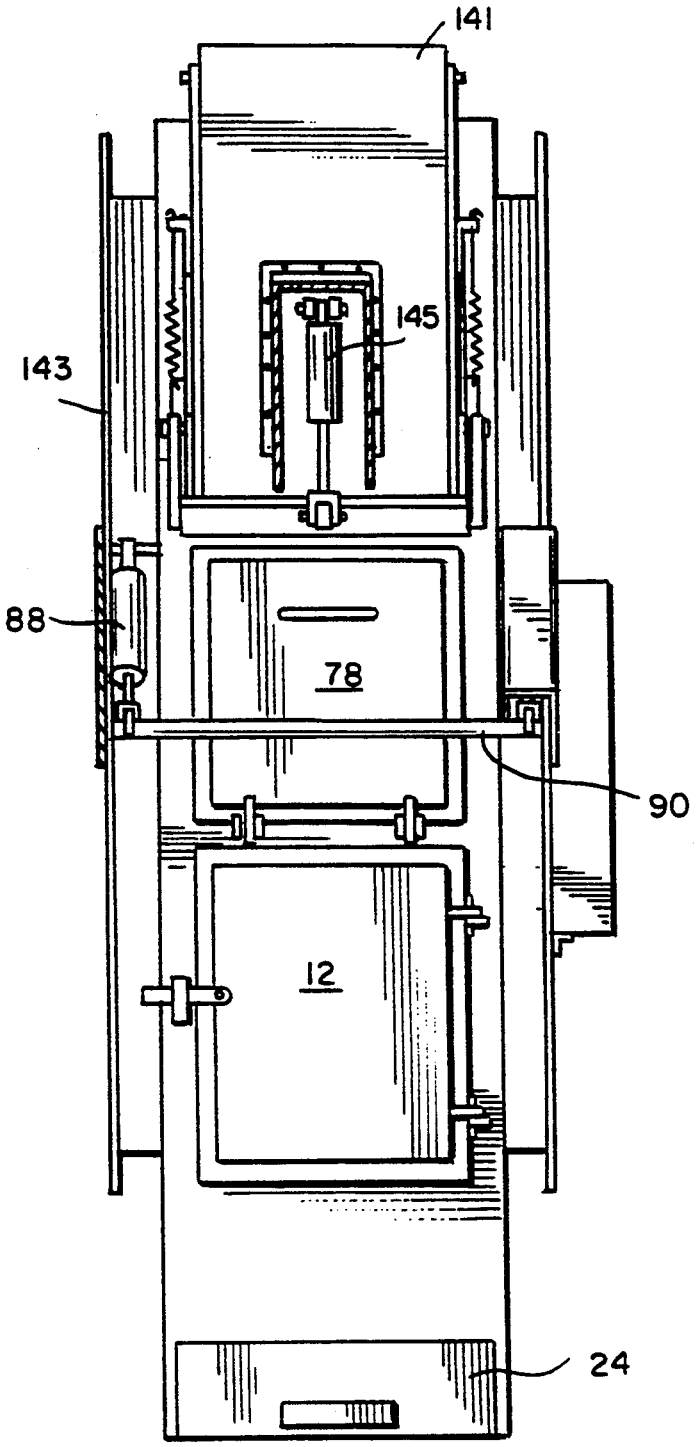
FIG. 7 is a front view of another modification of the firebox with relocated power cylinders, a housing around the actuators and a different hopper arrangement.
Figure 8:
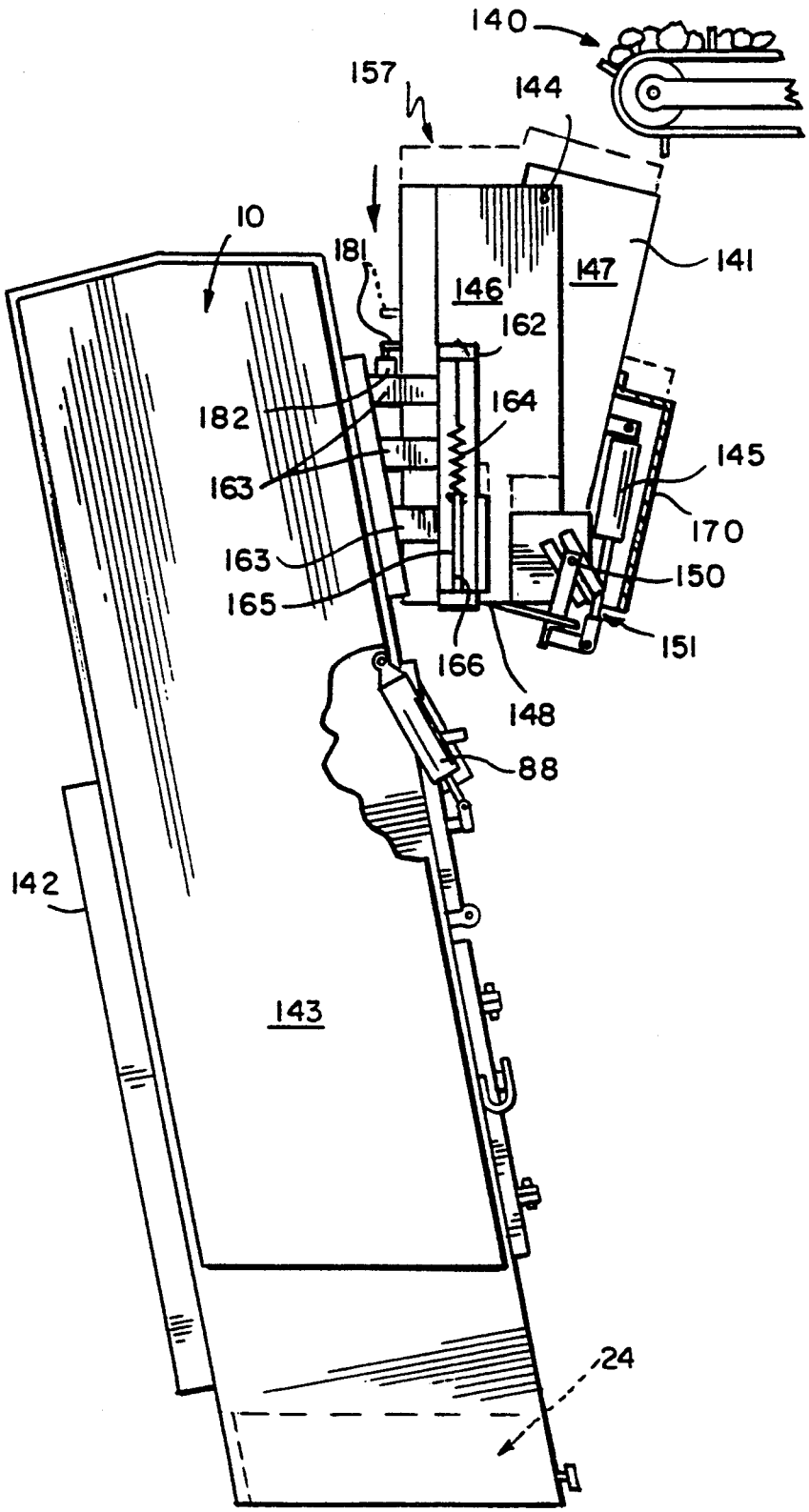
FIG. 8 is a side view of the FIG. 7 modification.
Figure 9:
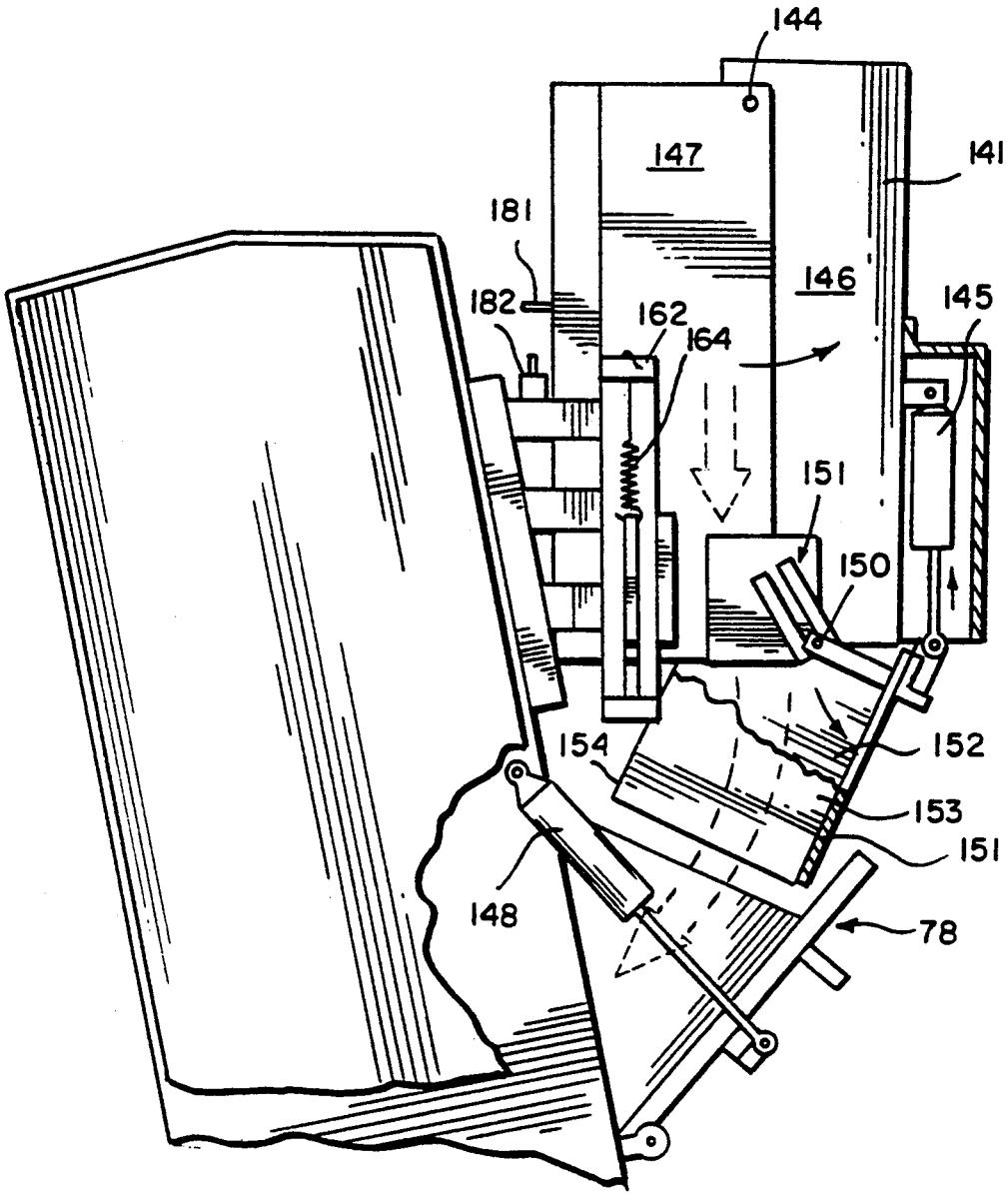
FIG. 9 is a side view of the FIG. 7 modification with the hopper in an open position.

The FIGS. 7–9 firebox is similar to the above except for a different hopper 141 structure (to be explained later) and with a housing cover 142 over the rearwardly located grate 30, 32 and 34, actuators 52 and a side house cover 143 over the entry funnel 78 actuators 88.

The hopper 141 is in two parts 146, 147 and the front part 147 bottom pivots forwardly about pivot 144 (see difference between FIG. 8 and 9) by means of actuator 145 enclosed in a housing 170 which at the same time opens bottom lid 148 in concert with actuator 88 opening funnel 78 to discharge fuel into the funnel. A rotable linkage with a pin 150 and slot 151 pivots the bottom 148 in the direction of the arrow (FIG. 9) at the same time as it pivots front hopper part 147. The bottom lid 148 has two sides 152, 153 and a back 154 to act as a chute to guide the fuel into the funnel 78, when opened and which sides and back are retracted into the hopper 141 when closed.

As previously indicated the amount of fuel fed to the hopper can be controlled by the weight of the fuel in the hopper causing the conveyor 140 to stop. To this end the hopper 140 is mounted to be vertically adjustable from the dotted line position 157 FIG. 8 to the full line as the weight of the fuel increases. A bracket 162 is mounted to the firebox 10 by a plurality of struts 163 and has attached thereto a spring 164 connected to a bar 165 attached to the rear portion 147 of the hopper 146 and constrained to move vertically in a slot 166. As the weight of fuel increases the spring 164 is tensioned and the bar 165 is moved downwardly (direction hollow arrow FIG. 9) to allow the hopper to descend. The movement of the back of the hopper causes a two part switch 181, 182 to be closed (see FIG. 8 and 9) to stop a motor (not shown) that drives the conveyor 140.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An automatic firebox for heating an area comprising:

a firebox enclosure having at least one fuel burning grate therein;

an upper fuel hopper means for storage of fuel;

an upper funnel means which can be moved from a closed to an open position for receiving fuel from the hopper means and passing the fuel onto the fuel grate in the firebox enclosure;

an ash receiving area in or under a lower end of the firebox;

a control means for sequential dumping material on the fuel burning grate into the ash receiving area, for opening the funnel means to receive fuel from the hopper, and for releasing fuel from the hopper.

2. The automatic firebox of claim 1 also including a door to the firebox for allowing human access into the firebox and initiation of ignition to start combustion in the firebox.

3. The automatic firebox of claim 1, wherein there are at least two fire grates in the firebox enclosure, one located vertically above another; and wherein the control means first dumps the lower of the fire grates to the ash receiving area and then dumps the upper of the grates to the lower fire grate before opening of the funnel means.

4. The automatic firebox of claim 2, wherein there are at least two fire grates in the firebox enclosure, one located vertically above another; and wherein the control means first dumps the lower of the fire grates to the ash receiving area and then dumps the upper of the grates to the lower fire grate before opening of the funnel means.

5. The automatic firebox of claim 3, wherein there is a third fire grate located between the upper and lower fire grates and wherein the control means dumps the middle fire grate to the lower fire grate, after the lower fire grate is dumped to the ash receiving area and then dumps the upper fire grate to the middle fire grate.

6. The automatic firebox of claim 4, wherein there is a third fire grate located between the upper and lower fire grates and wherein the control means dumps the middle fire grate to the lower fire grate, after the lower fire grate is dumped to the ash receiving area and then dumps the upper fire grate to the middle fire grate.

7. The automatic fire grate of claim 1, wherein at least one fire grate has two sections;

wherein each section is pivotally mounted within the firebox; and wherein the control means operates to pivot both sections of the fire grate to dump the fire grate.

8. The automatic fire grate of claim 2, wherein at least one fire grate has two sections;

wherein each section is pivotally mounted within the firebox; and wherein the control means operates to pivot both sections of the fire grate to dump the fire grate.

9. The automatic fire grate of claim 3, wherein at least one fire grate has two sections;

wherein each section is pivotally mounted within the firebox; and wherein the control means operates to pivot both sections of the fire grate to dump the fire grate.

10. The automatic fire grate of claim 4, wherein at least one fire grate has two sections;

wherein each section is pivotally mounted within the firebox; and wherein the control means operates to pivot both sections of the fire grate to dump the fire grate.

11. The automatic fire grate of claim 6, wherein at least one fire grate has two sections;

wherein each section is pivotally mounted within the firebox; and wherein the control means operates to pivot both sections of the fire grate to dump the fire grate.

12. A firebox according to claim 1, wherein the control means is operated in response to any one of:

a temperature of an area adjacent to the firebox; and a preset clock-time.

13. A firebox according to claim 2, wherein the control means is operated in response to any one of:

a temperature of an area adjacent to the firebox; and a preset clock-time.

14. A firebox according to claim 3, wherein the control means is operated in response to any one of:

a temperature of an area adjacent to the firebox; and a preset clock-time.

15. A firebox according to claim 5, wherein the control means is operated in response to any one of:

a temperature of an area adjacent to the firebox; and a preset clock-time.

16. A firebox according to claim 7, wherein the control means is operated in response to any one of:

a temperature of an area adjacent to the firebox; and a preset clock-time.

17. An automatic firebox according to claim 1, wherein the control means comprises motors connected to move crank arms that rotate the fuel burning grate to dump the grate, rotate the funnel from its closed to open position, and rotate a fuel grate of the hopper to release fuel to the funnel.

18. An automatic firebox according to claim 3, wherein the control means comprises motors connected to move crank arms that rotate the fuel burning grate to dump the grate, rotate the funnel from its closed to open position, and rotate a fuel grate of the hopper to release fuel to the funnel.

19. An automatic firebox according to claim 7, wherein the control means comprises motors connected to move crank arms that rotate the fuel burning grate to dump the grate, rotate the funnel from its closed to open position, and rotate a fuel grate of the hopper to release fuel to the funnel.

20. An automatic firebox according to claim 12, wherein the control means comprises motors connected to move crank arms that rotate the fuel burning grate to dump the grate, rotate the funnel from its closed to open position, and rotate a fuel grate of the hopper to release fuel to the funnel.

21. The automatic firebox of claims 1 wherein an external heat exchanger means is attached to the firebox for receiving exhaust gas therefrom to heat an area outside of the firebox.

22. The automatic firebox of claim 2 wherein an external heat exchanger means is attached to the firebox for receiving exhaust gas therefrom to heat an area outside of the firebox.

23. The automatic firebox of claim 3 wherein an external heat exchanger means is attached to the firebox for receiving exhaust gas therefrom to heat an area outside of the firebox.

24. The automatic firebox of claim 7 wherein an external heat exchanger means is attached to the firebox for receiving exhaust gas therefrom to heat an area outside of the firebox.

25. The automatic firebox of claim 1 wherein there is an exhaust gas purification means to receive and purify exhaust gases just before these gases exit from a primary combustion area of the firebox comprising:

a frame plate;

chimney means extending through the frame plate to permit passage of gases therethrough; and gas burner means to ignite any impurities in the exhaust gases passing through the chimneys.

26. The automatic firebox of claim 2 wherein there is an exhaust gas purification means to receive and purify exhaust gases just before these gases exit from a primary combustion area of the firebox comprising:

a frame plate;

chimney means extending through the frame plate to permit passage of gases therethrough; and gas burner means to ignite any impurities in the exhaust gases passing through the chimneys.

27. The automatic firebox of claim 3 wherein there is an exhaust gas purification means to receive and purify exhaust gases just before these gases exit from a primary combustion area of the firebox comprising:

a frame plate;

chimney means extending through the frame plate to permit passage of gases therethrough; and gas burner means to ignite any impurities in the exhaust gases passing through the chimneys.

28. The automatic firebox of claim 7 wherein there is an exhaust gas purification means to receive and purify exhaust gases just before these gases exit from a primary combustion area of the firebox comprising:

a frame plate;

chimney means extending through the frame plate to permit passage of gases therethrough; and gas burner means to ignite any impurities in the exhaust gases passing through the chimneys.

29. The automatic firebox of claim 21 wherein there is an exhaust gas purification means to receive and purify exhaust gases just before these gases exit from a primary combustion area of the firebox comprising:

a frame plate;

chimney means extending through the frame plate to permit passage of gases therethrough; and gas burner means to ignite any impurities in the exhaust gases passing through the chimneys.

30. The automatic firebox of claims 25 wherein the chimney means rest in port means in the frame plate on support ledges attached to the frame plate for ease in removal thereof from the firebox.

31. The automatic firebox of claims 26 wherein the chimney means rest in port means in the frame plate on support ledges attached to the frame plate for ease in removal thereof from the firebox.

32. The automatic firebox of claims 27 wherein the chimney means rest in port means in the frame plate on support ledges attached to the frame plate for ease in removal thereof from the firebox.

33. The automatic firebox of claims 28 wherein the chimney means rest in port means in the frame plate on support ledges attached to the frame plate for ease in removal thereof from the firebox.

34. The automatic firebox of claims 29 wherein the chimney means rest in port means in the frame plate on support ledges attached to the frame plate for ease in removal thereof from the firebox.

35. The automatic firebox of claim 1 wherein the automatic control means can be automatically or manual controlled to insure complete combustion of the fuel utilized in the firebox.

36. The automatic firebox of claim 35 wherein the fuel utilized is a non-fossil fuel.

37. The automatic firebox of claim 35 wherein the fuel utilized is a fossil fuel.

38. The automatic firebox of claim 37 wherein the fossil fuel is any one of aerosol cans, oil filters, and automobile tires.

39. The automatic firebox of claim 1 wherein exhaust gas recirculation means are provided to recirculate burned exhaust gas above the fuel burning gate back to a point adjacent the fuel gate for reburning thereat.

40. The automatic firebox of claim 25 wherein exhaust gas recirculation means are provided to recirculate burned exhaust gas above the fuel burning gate back to a point adjacent the fuel gate for reburning thereat.

41. The automatic firebox of claim 26 wherein exhaust gas recirculation means are provided to recirculate burned exhaust gas above the fuel burning gate back to a point adjacent the fuel gate for reburning thereat.

42. The automatic firebox of claim 28 wherein exhaust gas recirculation means are provided to recirculate burned exhaust gas above the fuel burning gate back to a point adjacent the fuel gate for reburning thereat.

43. The automatic firebox of claim 29 wherein exhaust gas recirculation means are provided to recirculate burned exhaust gas above the fuel burning gate back to a point adjacent the fuel gate for reburning thereat.

* * * * *